US009576590B2

(12) United States Patent
Sjoberg et al.

(10) Patent No.: US 9,576,590 B2
(45) Date of Patent: Feb. 21, 2017

(54) NOISE ADAPTIVE POST FILTERING

(75) Inventors: Jari Sjoberg, Kangasala (FI); Ville Myllyla, Tampere (FI); Emma Johanna Jokinen, Helsinki (FI); Paavo Ilmari Alku, Helsinki (FI); Hannu Juhani Pulakka, Espoo (FI)

(73) Assignee: Nokia Technologies Oy, Espoo (FI)

( * ) Notice: Subject to any disclaimer, the term of this patent is extended or adjusted under 35 U.S.C. 154(b) by 52 days.

(21) Appl. No.: 14/375,639

(22) PCT Filed: Feb. 24, 2012

(86) PCT No.: PCT/IB2012/050866

§ 371 (c)(1),
(2), (4) Date: Nov. 15, 2014

(87) PCT Pub. No.: WO2013/124712

PCT Pub. Date: Aug. 29, 2013

(65) Prior Publication Data

US 2015/0142425 A1 May 21, 2015

(51) Int. Cl.

| | |
|---|---|
| ***G10L 21/00*** | (2013.01) |
| ***G10L 21/0364*** | (2013.01) |
| ***G10L 19/26*** | (2013.01) |
| ***G10L 25/15*** | (2013.01) |
| ***G10L 21/0232*** | (2013.01) |

(52) U.S. Cl.

CPC ..... *G10L 21/0364* (2013.01); *G10L 19/26* (2013.01); *G10L 21/0232* (2013.01); *G10L 25/15* (2013.01)

(58) Field of Classification Search

CPC ..... G10L 21/02; G10L 21/0208; G10L 19/26
USPC ..... 704/228
See application file for complete search history.

(56) References Cited

U.S. PATENT DOCUMENTS

| | | | | |
|---|---|---|---|---|
| 6,233,552 | B1 * | 5/2001 | Mustapha | G10L 19/06 704/209 |
| 6,584,441 | B1 * | 6/2003 | Ojala | G10L 19/26 704/200 |
| 6,985,855 | B2 * | 1/2006 | Sluijter | G10L 19/22 704/201 |
| 8,554,548 | B2 * | 10/2013 | Ehara | G10L 19/26 375/240 |

(Continued)

FOREIGN PATENT DOCUMENTS

EP 2116997 11/2009

OTHER PUBLICATIONS

Niederjohn et al., "The Enhancement of Speech Intelligibility in High Noise Levels by High-Pass Filtering Followed by Rapid Amplitude Compression", IEEE Transactions on Acoustics, Speech and Signal Processing, vol. 24, No. 4, Aug. 1976, pp. 277-282.

(Continued)

*Primary Examiner* — Daniel Abebe
(74) *Attorney, Agent, or Firm* — Alston & Bird LLP

(57) ABSTRACT

An apparatus comprising at least one processor and at least one memory including computer code for one or more programs, the at least one memory and the computer code configured to with the at least one processor to cause the apparatus to at least perform: estimating a signal to noise ratio value for an audio signal; generating a post-filter comprising at least one of: a first formant frequency filter and a second formant frequency filter, wherein the post-filter is dependent on the signal to noise ratio value for the audio signal.

18 Claims, 5 Drawing Sheets

(56) References Cited

U.S. PATENT DOCUMENTS

| | | | | |
|---|---|---|---|---|
| 2004/0143439 | A1* | 7/2004 | Kang | G10L 19/04 704/262 |
| 2005/0091046 | A1* | 4/2005 | Thyssen | G10L 21/0364 704/211 |
| 2006/0116874 | A1* | 6/2006 | Samuelsson | G10L 19/26 704/228 |
| 2006/0270467 | A1 | 11/2006 | Song et al. | |
| 2009/0281800 | A1 | 11/2009 | Leblanc et al. | |
| 2010/0004927 | A1 | 1/2010 | Endo et al. | |
| 2010/0088092 | A1* | 4/2010 | Bruhn | G10L 21/02 704/228 |
| 2011/0125491 | A1 | 5/2011 | Alves et al. | |
| 2011/0125507 | A1* | 5/2011 | Yu | G10L 21/0364 704/500 |

OTHER PUBLICATIONS

Skowronski et al., "Applied Principles of Clear and Lombard Speech for Automated Intelligibility Enhancement in Noisy Environments", Speech Communication, vol. 48, No. 5, May 2006, pp. 549-558.

Jayant, "Adaptive Post-Filtering of ADPCM Speech", The Bell System Technical Journal, vol. 60, No. 5, May-Jun. 1981, pp. 707-717.

Chen et al., "Adaptive Post-filtering for Quality Enhancement of Coded Speech", IEEE Transactions on Speech and Audio Processing, vol. 3, No. 1, Jan. 1995, pp. 59-71.

Mustapha et al., An Adaptive Post-Filtering Technique Based on the Modified Yule-Walker Filter, IEEE International Conference on Acoustics, Speech, and Signal Processing, vol. 1, Mar. 15-19, 1999, pp. 197-200.

Grancharov et al., "Generalized Postfilter for Speech Quality Enhancement", IEEE Transactions on Audio, Speech, and Language Processing, vol. 16, No. 1, Jan. 2008, pp. 57-64.

Tang et al., "Energy Reallocation Strategies for Speech Enhancement in Known Noise Conditions", Proceedings of Interspeech, 2010, 4 Pages.

Laaksonen et al., "Artificial Bandwidth Expansion Method to Improve Intelligibility and Quality of AMR-Coded Narrowband Speech", IEEE International Conference on Acoustics, Speech, and Signal Processing, vol. 1, Mar. 18-23, 2005, pp. 809-812.

Chen et al., "Perceptual Postfilter Estimation for Low Bit Rate Speech Coders Using Gaussian Mixture Models", Proceedings of the Interspeech, Sep. 4-8, 2005, 4 pages.

"3rd Generation Partnership Project;Technical Specification Group Services and System Aspects;Mandatory Speech Codec speech processing functions;Adaptive Multi-Rate (AMR) speech codec; Transcoding functions(Release 8)", 3GPP TS 26.090, V8.0.0, Dec. 2008, pp. 1-55.

Pulakka et al., "Bandwidth Extension of Telephone Speech Using a Filter Bank Implementation for Highband Mel Spectrum", 18th European Signal Processing Conference, Aug. 23-27, 2010, pp. 979-983.

Vainio et al., "Developing a speech Intelligibility Test Based on Measuring Speech Reception Thresholds in Noise for English and Finnish", The Journal of the Acoustical Society of America, vol. 118, No. 3, 2005, pp. 1742-1750.

Thomas et al., "The Intelligibility of Filtered-Clipped Speech in Noise", Journal of the Audio Engineering Society, vol. 18, No. 3, Jun. 1, 1970, pp. 299-302.

Yoo et al., Speech Signal Modification to Increase Intelligibility in Noisy Environments, the Journal of the Acoustical Society of America , vol. 122, No. 2, 2007, pp. 1138-1149.

Hall et al., Intelligibility and Listener Preference of Telephone Speech in the Presence of Babble Noise, the Journal of the Acoustical Society of America, vol. 127, No. 1, 2010, pp. 280-285.

International Search Report received for corresponding Patent Cooperation Treaty Application No. PCT/IB2012/050866 , dated Feb. 7, 2013, 5 pages.

Jokinen E. "Adaptive post-filtering of speech in mobile communications", Aalto University Library 2010, p. 1-71. Retrieved from Internet <URL: https://aaltodoc.aalto.fi/bitstream/handle/123456789/3279/urn100278.pdf?sequence=1>.

* cited by examiner

NOISE ADAPTIVE POST FILTERING

RELATED APPLICATION

This application was originally filed as PCT Application No. PCT/IB2012/050866 filed Feb. 24, 2012.

FIELD

The present application relates to a noise adaptive post filtering, and in particular, but not exclusively to a noise adaptive post filtering for use in speech or speech like audio.

BACKGROUND

Mobile phone and wireless communication use is continuously expanding. Often mobile phones are used in noisy real life environments and/or in a hands free operation mode which results in degradation of the mobile telephone speech because of the noise found in real life environments. Speech enhancement of audio signals can be applied to improve the quality and intelligibility of speech degraded by noise. An approach to speech enhancement is post processing, where the output of a speech decoded signal is further processed. One example of this is the post-processing block in the adaptive multi-rate (AMR) narrowband codec standard (operating within the 0.3 to 3.4 kilohertz frequency range).

Post-processing can further be used to overcome quantisation noise generated by low bit rate speech encoders. Post-processing can be typically implemented in the form of post-filtering. In other words filtering the decoded speech signal with an adaptive filter in order to reduce the effects of environmental noise and enhancing the perceptual quality of the speech.

SUMMARY

Embodiments attempt to address the above problem.

There is provided according to a first aspect a method comprising: estimating a signal to noise ratio value for an audio signal; generating a post-filter comprising at least one of: a first formant frequency filter and a second formant frequency filter, wherein the post-filter is dependent on the signal to noise ratio value for the audio signal.

The post-filter may be configured to move energy of the audio signal to higher frequencies.

Generating a post-filter comprising a first formant frequency filter may comprise generating a first formant frequency parameter configured to attenuate the first formant frequency components of the audio signal dependent on the signal to noise ratio value for the audio signal.

Generating a post-filter formant frequency parameter dependent on the signal to noise ratio value for the audio signal may comprise: comparing the signal to noise ratio value for the audio signal against a first signal to noise ratio threshold value; generating a maximum post-filter first formant frequency parameter value dependent on the signal to noise ratio value for the audio signal being greater than the signal to noise ratio threshold value; and generating a second post-filter first formant frequency parameter value dependent on the signal to noise ratio value for the audio signal being less than the signal to noise ratio threshold value.

Generating a second post-filter first formant frequency parameter value dependent on the signal to noise ratio value for the audio signal being less than the signal to noise ratio threshold value may comprise: comparing the signal to noise ratio value for the audio signal against a second signal to noise ratio threshold value, wherein the second signal to noise ratio threshold value is lower than the first signal to noise ratio threshold value; setting the second post-filter first formant frequency parameter value to at least one of: a minimum post-filter first formant frequency parameter value when the signal to noise ratio value for the audio signal is equal to or less than the second signal to noise ratio threshold value, and an interpolated value between the minimum post-filter first formant frequency parameter value and the maximum post-filter first formant frequency parameter value when the signal to noise ratio value for the audio signal is greater than the second signal to noise ratio threshold value but less than the first signal to noise ratio threshold value.

Setting the second post-filter first formant frequency parameter value to an interpolated value may comprise setting to at least one of: a linearly interpolated value; and a non-linearly interpolated value.

The method may further comprise generating a post-filter neutralization factor dependent on the signal to noise ratio for the audio signal.

Generating a post-filter neutralization factor dependent on the signal to noise ratio for the audio signal may comprise: comparing the signal to noise ratio value for the audio signal against a first signal to noise ratio threshold value; generating a minimum post-filter neutralization factor dependent on the signal to noise ratio value for the audio signal being less than the signal to noise ratio threshold value; and generating a second post-filter neutralization factor dependent on the signal to noise ratio value for the audio signal being greater than the signal to noise ratio threshold value.

Generating a second post-filter neutralization factor dependent on the signal to noise ratio value for the audio signal being greater than the signal to noise ratio threshold value may comprise: generating a maximum post-filter neutralization factor when the signal to noise ratio value for the audio signal is greater than a third signal to noise ratio threshold, the third signal to noise ratio threshold being greater than the first signal to noise ratio threshold; and generating an interpolated post-filter neutralization factor between the maximum post-filter neutralization factor and the minimum post-filter neutralization factor when the signal to noise ratio value for the audio signal is greater than the first signal to noise ratio threshold and less than the third signal to noise ratio threshold.

Generating an interpolated post-filter neutralization factor may comprise generating: a linear interpolation; and a non-linear interpolation.

Generating a post-filter comprising the second formant frequency filter may comprises generating a formant frequency parameter configured to amplify the second formant frequency component of the audio signal relative to the first formant frequency dependent on the signal to noise ratio value for the audio signal.

The method may further comprise estimating the second formant frequency.

The method may further comprise estimating the first formant frequency.

Estimating a signal to noise ratio value for an audio signal may comprise at least one of: generating a smoothed signal to noise ratio: and low pass filtering an estimated signal to noise ratio over at least two frames of the audio signal.

An apparatus comprising at least one processor and at least one memory including computer code for one or more programs, the at least one memory and the computer code configured to with the at least one processor to cause the apparatus to at least perform: estimating a signal to noise ratio value for an audio signal; generating a post-filter comprising at least one of: a first formant frequency filter and a second formant frequency filter, wherein the post-filter is dependent on the signal to noise ratio value for the audio signal.

The post-filter may be configured to move energy of the audio signal to higher frequencies.

Generating a post-filter comprising a first formant frequency filter may cause the apparatus to perform generating a first formant frequency parameter configured to attenuate the first formant frequency components of the audio signal dependent on the signal to noise ratio value for the audio signal.

Generating a post-filter formant frequency parameter dependent on the signal to noise ratio value for the audio signal may cause the apparatus to perform: comparing the signal to noise ratio value for the audio signal against a first signal to noise ratio threshold value; generating a maximum post-filter first formant frequency parameter value dependent on the signal to noise ratio value for the audio signal being greater than the signal to noise ratio threshold value; and generating a second post-filter first formant frequency parameter value dependent on the signal to noise ratio value for the audio signal being less than the signal to noise ratio threshold value.

Generating a second post-filter first formant frequency parameter value dependent on the signal to noise ratio value for the audio signal being less than the signal to noise ratio threshold value may cause the apparatus to perform: comparing the signal to noise ratio value for the audio signal against a second signal to noise ratio threshold value, wherein the second signal to noise ratio threshold value is lower than the first signal to noise ratio threshold value; setting the second post-filter first formant frequency parameter value to at least one of: a minimum post-filter first formant frequency parameter value when the signal to noise ratio value for the audio signal is equal to or less than the second signal to noise ratio threshold value, and an interpolated value between the minimum post-filter first formant frequency parameter value and the maximum post-filter first formant frequency parameter value when the signal to noise ratio value for the audio signal is greater than the second signal to noise ratio threshold value but less than the first signal to noise ratio threshold value.

The interpolated value may comprise at least one of: a linearly interpolated value; and a non-linearly interpolated value.

The apparatus may be caused to perform generating a post-filter neutralization factor dependent on the signal to noise ratio for the audio signal.

Generating a post-filter neutralization factor dependent on the signal to noise ratio for the audio signal may cause the apparatus to perform: comparing the signal to noise ratio value for the audio signal against a first signal to noise ratio threshold value; generating a minimum post-filter neutralization factor dependent on the signal to noise ratio value for the audio signal being less than the signal to noise ratio threshold value; and generating a second post-filter neutralization factor dependent on the signal to noise ratio value for the audio signal being greater than the signal to noise ratio threshold value.

Generating a second post-filter neutralization factor dependent on the signal to noise ratio value for the audio signal being greater than the signal to noise ratio threshold value may cause the apparatus to perform: generating a maximum post-filter neutralization factor when the signal to noise ratio value for the audio signal is greater than a third signal to noise ratio threshold, the third signal to noise ratio threshold being greater than the first signal to noise ratio threshold; and generating an interpolated post-filter neutralization factor between the maximum post-filter neutralization factor and the minimum post-filter neutralization factor when the signal to noise ratio value for the audio signal is greater than the first signal to noise ratio threshold and less than the third signal to noise ratio threshold.

Generating an interpolated post-filter neutralization factor may cause the apparatus to perform: a linear interpolation; and a non-linear interpolation.

Generating a post-filter comprising the second formant frequency filter may cause the apparatus to perform generating a formant frequency parameter configured to amplify the second formant frequency component of the audio signal relative to the first formant frequency dependent on the signal to noise ratio value for the audio signal.

The apparatus may be caused to perform estimating the second formant frequency.

The apparatus may be caused to perform estimating the first formant frequency.

Estimating a signal to noise ratio value for an audio signal may cause the apparatus to perform at least one of: generating a smoothed signal to noise ratio: and low pass filtering an estimated signal to noise ratio over at least two frames of the audio signal.

An apparatus comprising: a signal to noise estimator configured to estimate a signal to noise ratio value for an audio signal; a post-filter generator configured to generate a post-filter comprising at least one of: a first formant frequency filter and a second formant frequency filter, wherein the post-filter is dependent on the signal to noise ratio value for the audio signal.

The post-filter may be configured to move energy of the audio signal to higher frequencies.

The post-filter generator may comprise a first formant filter generator configured to generate a first formant frequency parameter configured to attenuate the first formant frequency components of the audio signal dependent on the signal to noise ratio value for the audio signal.

The first formant filter generator may comprise: a comparator configured to compare the signal to noise ratio value for the audio signal against a first signal to noise ratio threshold value; a maximum parameter determiner configured to generate a maximum post-filter first formant frequency parameter value dependent on the signal to noise ratio value for the audio signal being greater than the signal to noise ratio threshold value; and a second parameter determiner configured to generate a second post-filter first formant frequency parameter value dependent on the signal to noise ratio value for the audio signal being less than the signal to noise ratio threshold value.

The second parameter determiner may comprise: a second parameter comparator configured to compare the signal to noise ratio value for the audio signal against a second signal to noise ratio threshold value, wherein the second signal to noise ratio threshold value is lower than the first signal to noise ratio threshold value; a parameter setter configured to set the second post-filter first formant frequency parameter value to at least one of: a minimum post-filter first formant frequency parameter value when the signal to noise ratio value for the audio signal is equal to or less than the second signal to noise ratio threshold value, and an interpolated value between the minimum post-filter first formant frequency parameter value and the maximum post-filter first formant frequency parameter value when the signal to noise ratio value for the audio signal is greater than the second signal to noise ratio threshold value but less than the first signal to noise ratio threshold value.

The interpolated value may comprise at least one of: a linearly interpolated value; and a non-linearly interpolated value.

The apparatus may further comprise a post-filter neutralization factor generator dependent on the signal to noise ratio for the audio signal.

The post-filter neutralization factor generator may comprise: a comparator configured to compare the signal to noise ratio value for the audio signal against a first signal to noise ratio threshold value; and a factor generator configured to generate a minimum post-filter neutralization factor dependent on the signal to noise ratio value for the audio signal being less than the signal to noise ratio threshold value, and a second factor dependent on the signal to noise ratio value for the audio signal being greater than the signal to noise ratio threshold value.

The factor generator may be configured to generate: a maximum post-filter neutralization factor when the signal to noise ratio value for the audio signal is greater than a third signal to noise ratio threshold, the third signal to noise ratio threshold being greater than the first signal to noise ratio threshold; and an interpolated post-filter neutralization factor between the maximum post-filter neutralization factor and the minimum post-filter neutralization factor when the signal to noise ratio value for the audio signal is greater than the first signal to noise ratio threshold and less than the third signal to noise ratio threshold.

The interpolated post-filter neutralization factor may comprise: a linear interpolation; and a non-linear interpolation.

The post-filter generator may comprise a second formant frequency parameter generator, the second formant frequency parameter configured to amplify the second formant frequency component of the audio signal relative to the first formant frequency dependent on the signal to noise ratio value for the audio signal.

The apparatus may comprise a second formant frequency estimator configured to estimate the second formant frequency.

The apparatus may comprise a first formant frequency estimator configured to estimate the first formant frequency.

The signal to noise ratio estimator may comprise at least one of: a smoothed signal to noise ratio estimator configured to generate a smoothed signal to noise ratio: and a low pass filtered signal to noise ratio estimator configured to low pass filter an estimated signal to noise ratio over at least two frames of the audio signal.

An apparatus comprising: means for estimating a signal to noise ratio value for an audio signal; means for generating a post-filter comprising at least one of: a first formant frequency filter and a second formant frequency filter, wherein the post-filter is dependent on the signal to noise ratio value for the audio signal.

The post-filter may be configured to move energy of the audio signal to higher frequencies.

The means for generating a post-filter comprising a first formant frequency filter may comprise means for generating a first formant frequency parameter configured to attenuate the first formant frequency components of the audio signal dependent on the signal to noise ratio value for the audio signal.

The means for generating a post-filter formant frequency parameter dependent on the signal to noise ratio value for the audio signal may comprise: means for comparing the signal to noise ratio value for the audio signal against a first signal to noise ratio threshold value; means for generating a maximum post-filter first formant frequency parameter value dependent on the signal to noise ratio value for the audio signal being greater than the signal to noise ratio threshold value; and means for generating a second post-filter first formant frequency parameter value dependent on the signal to noise ratio value for the audio signal being less than the signal to noise ratio threshold value.

The means for generating a second post-filter first formant frequency parameter value dependent on the signal to noise ratio value for the audio signal being less than the signal to noise ratio threshold value may comprise: means for comparing the signal to noise ratio value for the audio signal against a second signal to noise ratio threshold value, wherein the second signal to noise ratio threshold value is lower than the first signal to noise ratio threshold value; and means for setting the second post-filter first formant frequency parameter value to at least one of: a minimum post-filter first formant frequency parameter value when the signal to noise ratio value for the audio signal is equal to or less than the second signal to noise ratio threshold value, and an interpolated value between the minimum post-filter first formant frequency parameter value and the maximum post-filter first formant frequency parameter value when the signal to noise ratio value for the audio signal is greater than the second signal to noise ratio threshold value but less than the first signal to noise ratio threshold value.

The means for setting the second post-filter first formant frequency parameter value to an interpolated value may comprise means for setting to at least one of: a linearly interpolated value; and a non-linearly interpolated value.

The apparatus may further comprise means for generating a post-filter neutralization factor dependent on the signal to noise ratio for the audio signal.

The means for generating a post-filter neutralization factor dependent on the signal to noise ratio for the audio signal may comprise: means for comparing the signal to noise ratio value for the audio signal against a first signal to noise ratio threshold value; means for generating a minimum post-filter neutralization factor dependent on the signal to noise ratio value for the audio signal being less than the signal to noise ratio threshold value; and means for generating a second post-filter neutralization factor dependent on the signal to noise ratio value for the audio signal being greater than the signal to noise ratio threshold value.

The means for generating a second post-filter neutralization factor dependent on the signal to noise ratio value for the audio signal being greater than the signal to noise ratio threshold value may comprise: means for generating a maximum post-filter neutralization factor when the signal to noise ratio value for the audio signal is greater than a third signal to noise ratio threshold, the third signal to noise ratio threshold being greater than the first signal to noise ratio threshold; and means for generating an interpolated post-filter neutralization factor between the maximum post-filter neutralization factor and the minimum post-filter neutralization factor when the signal to noise ratio value for the audio signal is greater than the first signal to noise ratio threshold and less than the third signal to noise ratio threshold.

The means for generating an interpolated post-filter neutralization factor may comprise means for generating: a linear interpolation; and a non-linear interpolation.

The means for generating a post-filter comprising the second formant frequency filter may comprise means for generating a formant frequency parameter configured to amplify the second formant frequency component of the audio signal relative to the first formant frequency dependent on the signal to noise ratio value for the audio signal.

The apparatus may further comprise means for estimating the second formant frequency.

The apparatus may further comprise means for estimating the first formant frequency.

The means for estimating a signal to noise ratio value for an audio signal may comprise at least one of: means for generating a smoothed signal to noise ratio: and means for low pass filtering an estimated signal to noise ratio over at least two frames of the audio signal.

An electronic device may comprise apparatus as described above.

A chipset may comprise apparatus as described above.

BRIEF DESCRIPTION OF DRAWINGS

For better understanding of the present invention, reference will now be made by way of example to the accompanying drawings in which.

DESCRIPTION OF SOME EMBODIMENTS OF THE APPLICATION

Figure 1:
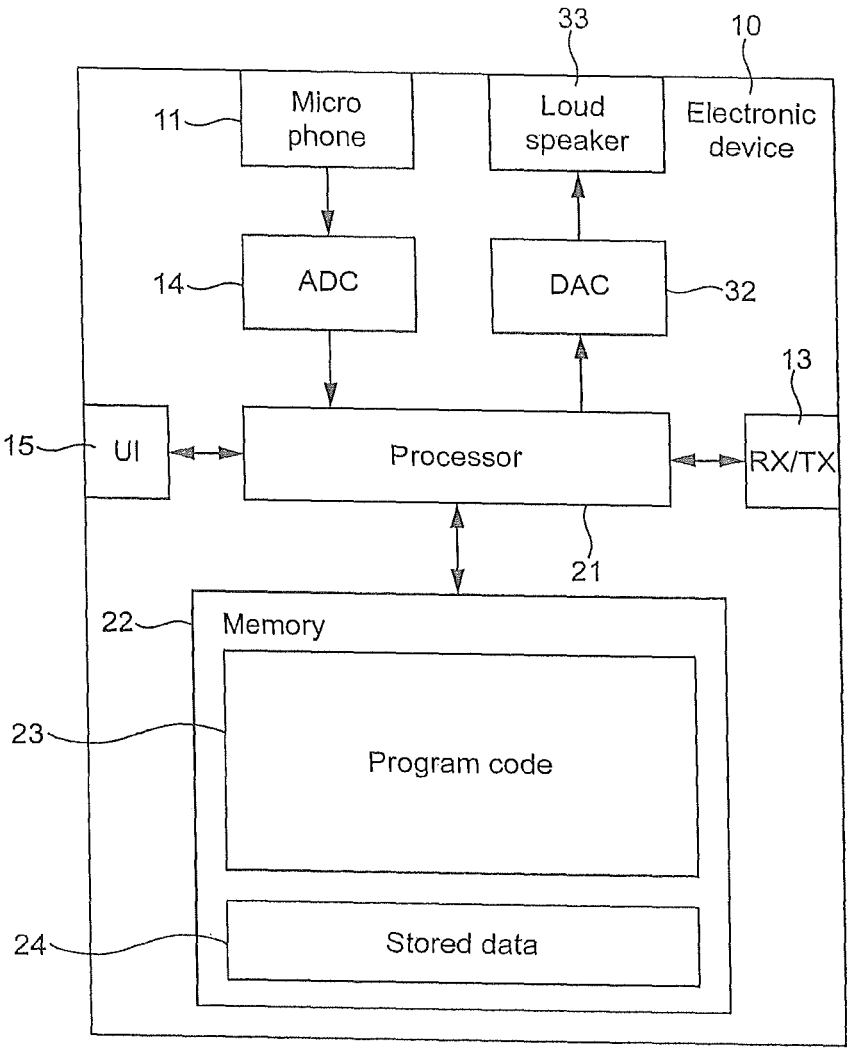
FIG. 1 shows schematically an electronic device employing some embodiments of the application.

The following describes in more detail possible noise adaptive post filtering for use in speech or speech like audio for the provision of higher quality voice communication. In this regard reference is first made to FIG. 1 which shows a schematic block diagram of an exemplary electronic device or apparatus 10, which may incorporate a noise adaptive post filtering apparatus according to an embodiment of the application.

The apparatus 10 may for example be a mobile terminal or user equipment of a wireless communication system. In other embodiments the apparatus 10 may be an audio-video device such as video camera, a Television (TV) receiver, audio recorder or audio player such as a mp3 recorder/player, a media recorder (also known as a mp4 recorder/player), or any computer suitable for the processing of audio signals.

The electronic device or apparatus 10 in some embodiments comprises a microphone 11, which is linked via an analogue-to-digital converter (ADC) 14 to a processor 21. The processor 21 is further linked via a digital-to-analogue (DAC) converter 32 to loudspeakers 33. The processor 21 is further linked to a transceiver (RX/TX) 13, to a user interface (UI) 15 and to a memory 22.

The processor 21 can in some embodiments be configured to execute various program codes. The implemented program codes in some embodiments comprise noise adaptive post filtering code as described herein. The implemented program codes 23 can in some embodiments be stored for example in the memory 22 for retrieval by the processor 21 whenever needed. The memory 22 could further provide a section 24 for storing data, for example data that has been encoded in accordance with the application.

The noise adaptive post filtering code in embodiments can be implemented in hardware or firmware.

The user interface 15 enables a user to input commands to the electronic device 10, for example via a keypad, and/or to obtain information from the electronic device 10, for example via a display. In some embodiments a touch screen may provide both input and output functions for the user interface. The apparatus 10 in some embodiments comprises a transceiver 13 suitable for enabling communication with other apparatus, for example via a wireless communication network.

It is to be understood again that the structure of the apparatus 10 could be supplemented and varied in many ways.

A user of the apparatus 10 for example can use the microphone 11 for inputting speech or other audio signals that are to be transmitted to some other apparatus or that are to be stored in the data section 24 of the memory 22.

The analogue-to-digital converter (ADC) 14 in some embodiments converts the input analogue audio signal into a digital audio signal and provides the digital audio signal to the processor 21. In some embodiments the microphone 11 can comprise an integrated microphone and ADC function and provide digital audio signals directly to the processor for processing.

The processor 21 in such embodiments then processes the digital audio signal according to any suitable encoding process, for example a suitable adaptable multi-rate (AMR) coding or codec.

The resulting bit stream can in some embodiments be provided to the transceiver 13 for transmission to another apparatus. Alternatively, the coded audio data in some embodiments can be stored in the data section 24 of the memory 22, for instance for a later transmission or for a later presentation by the same apparatus 10.

The apparatus 10 in some embodiments can also receive a bit stream with correspondingly encoded data from another apparatus via the transceiver 13. In this example, the processor 21 may execute decoding program code stored in the memory 22. The processor 21 in such embodiments decodes the received data. Furthermore the processor 21 in some embodiments can be configured to apply noise adaptive post-filtering as described herein, and provide the signal output to a digital-to-analogue converter 32. The digital-to-analogue converter 32 converts the signal into analogue audio data and can in some embodiments output the analogue audio via the loudspeakers 33. Execution of the decoding and noise adaptive post filtering program code in some embodiments can be triggered by an application called by the user via the user interface 15.

The received encoded data in some embodiments can also be stored instead of an immediate presentation via the loudspeakers 33 in the data section 24 of the memory 22, for instance for later decoding, noise adaptive post filtering and presentation or decoding and forwarding to still another apparatus.

Figure 2:
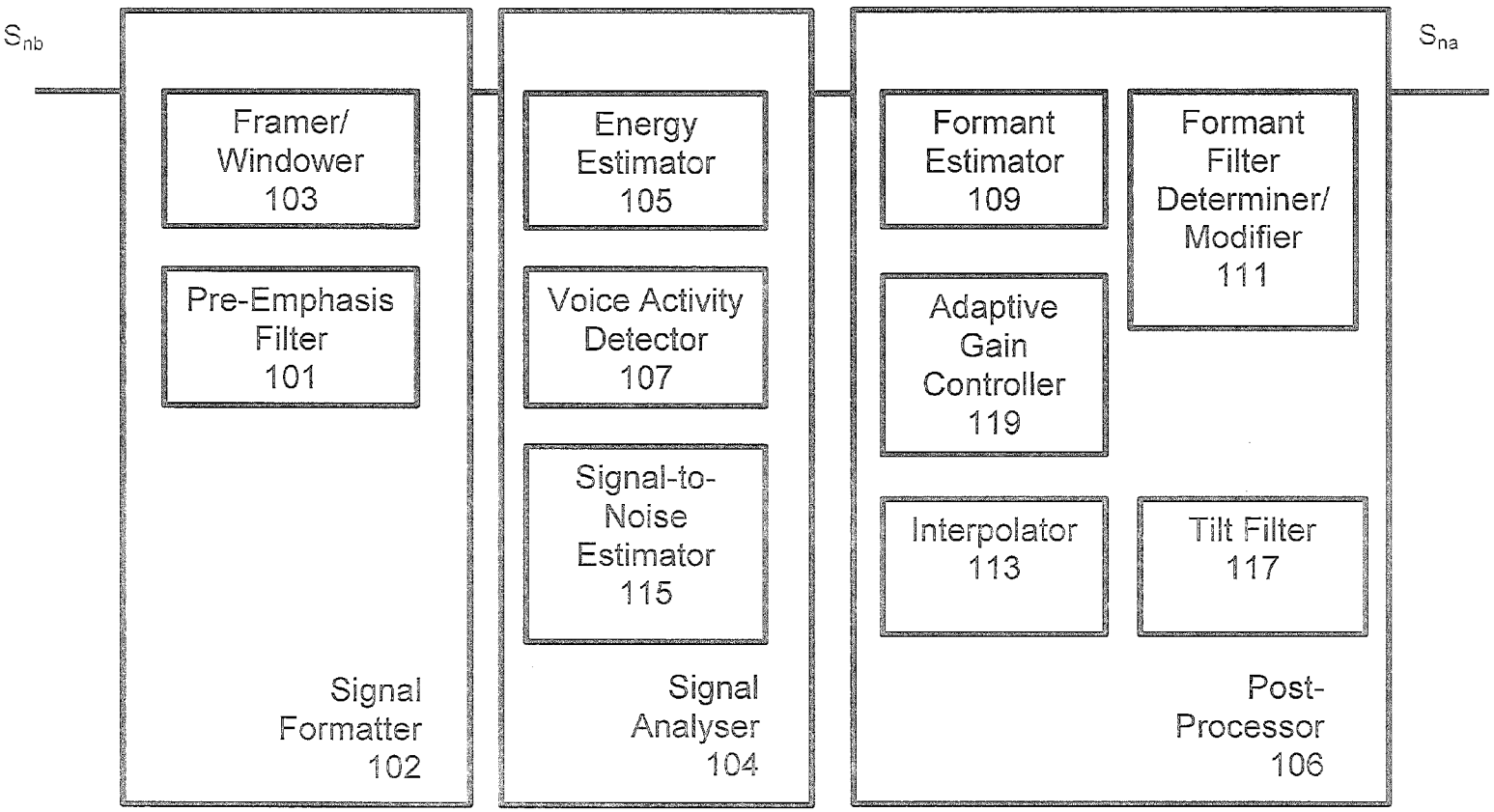
FIG. 2 shows schematically an audio post processor apparatus according to some embodiments.
Figure 3:
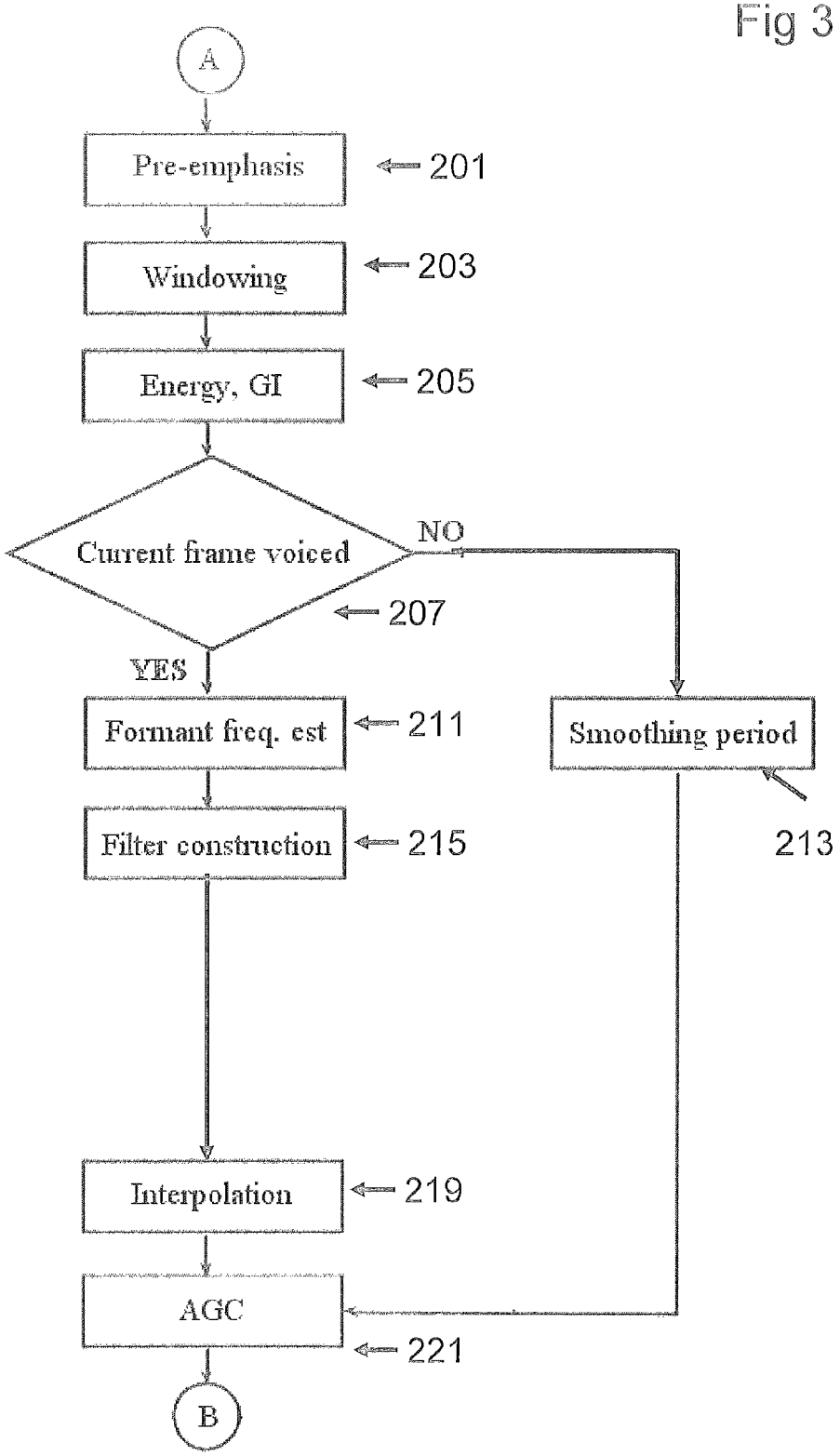
FIG. 3 shows schematically the operation of the audio post processor apparatus according to some embodiments.
Figure 4:
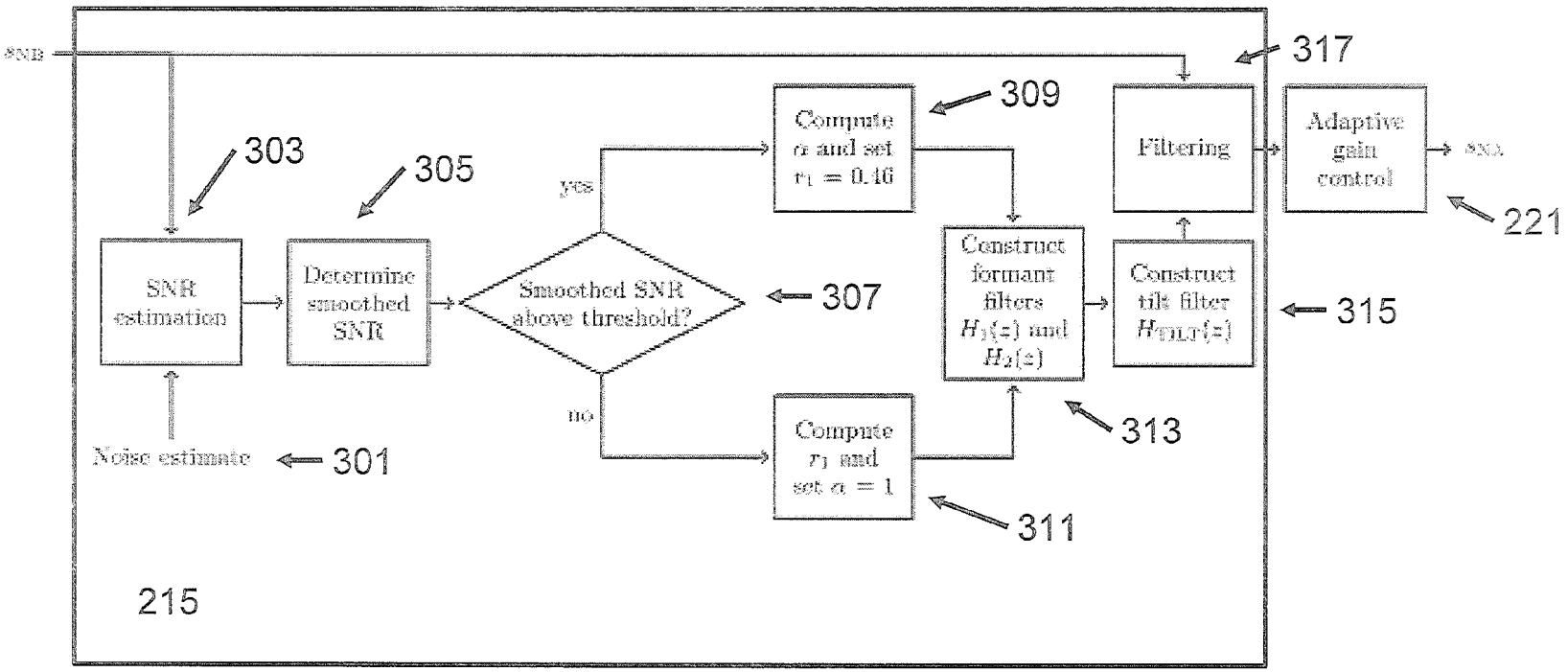
FIG. 4 shows schematically the operation of the audio post processor formant filter noise adaptation according to some embodiments.

It would be appreciated that the schematic structures described in FIG. 2, and the method steps shown in FIGS. 3 and 4 represent only a part of the operation of an audio codec and specifically noise adaptive post filtering apparatus or method as exemplarily shown implemented in the apparatus shown in FIG. 1.

The concept of the application is to improve the intelligibility of mobile phone speech in severe noise conditions. High levels of environmental noise can corrupt the audio signal containing speech and produce poor quality outputs. In the embodiments described herein the post-processing apparatus is configured too post-filter the audio signal so to attenuate the first formant and enhance the second formant adaptively according to the estimated noise level. In such a way the acoustic cues in higher frequencies are raised above the noise level.

With respect to FIG. 2 an example post-processing apparatus is shown according to some embodiments of the application. Furthermore with respect to FIGS. 3 and 4 the operation of the post processing apparatus according to FIG. 2 is shown in further detail.

In some embodiments the post processing apparatus comprises a signal formatter 102 configured to receive the input narrowband signal $S_{nb}$ and format the signal into a form suitable for post processing.

In some embodiments the signal formatter comprises a pre-emphasis filter 101.

The pre-emphasis filter can be any suitable filter such as $$H(z)=1+\alpha_1 z^{-1},$$

where $a_1$ is a first order high pass filter coefficient.

In some embodiments the output of the pre emphasis filter is passed to the framer/windower 103

The operation of performing the pre emphasis filtering is shown in FIG. 3 by step 201.

In some embodiments the signal formatter 102 can comprise a framer/windower 103.

The framer/windower 103 can in some embodiments be configured to receive the audio signal and frame/window the audio signal into a suitable series of windowed or framed time samples. It would be understood that in some embodiments the audio signal is processed into separate frames of approximately 20 ms with a sampling frequency of 8 kHz. However it would be understood that any suitable frame length, sampling and overlap can be implemented. In some embodiments the framer/windower 103 is configured to extract the frames from the audio signal using a rectangular window. However any suitable windowing function can be used in some other embodiments. For example in some embodiments a regular hamming window can be used.

The output of the framer/windower 103 can be passed to a signal analyser 104.

The operation of windowing the audio signal is shown in FIG. 3 by step 203.

The framer/windower 103 can be configured in some embodiments to output the filtered windowed audio signal to the signal analyser 104.

In some embodiments the post processor apparatus comprises a signal analyser 104. The signal analyser 104 can be configured to analyse the signal to produce input or control values for the post-processor 106.

In some embodiments the signal analyser 104 comprises an energy estimator 105. The energy estimator 105 is configured to determine the energy of the framed audio signal.

The energy can be calculated using any suitable energy estimation method. For example in some embodiments the squares of the absolute sample values are summed or averaged over a frame to generate a frame audio signal energy value.

The operation of estimating the energy of the frame is shown in FIG. 3 by step 205.

Furthermore in some embodiments the signal analyser 104 comprises a voice activity detector 107. The voice activity detector 107 can in some embodiments determine a gradient index for a frame (n) using the following expression $$X_{GI}(n)=\frac{\sum_{k=1}^{N_k-1}\Psi(k)|s(k)-s(k-1)|}{\sqrt{\sum_{k=0}^{N_k-1}((s(k))^2)}},$$

$$\text{where } \Psi(k)=\frac{1}{2}|\psi(k)-\psi(k-1)|,$$

$$\psi(k)=\begin{cases}-1, & s(k)-s(k-1)<0\\ 0, & s(k)-s(k-1)=0\\ 1, & s(k)-s(k-1)>0\end{cases},$$

where $N_k$ is the frame size and s is the audio signal.

The voice activity detector 107 can then be configured in some embodiments to classify whether the frame is voiced where the gradient index value ($X_{GI}$) is lower than a determined limit ($GI_{Limit}$) and the frame energy is above a predefined limit ($E_{Limit}$). In some embodiments the threshold or defined values can be determined by testing known speech material. For example in some embodiments the gradient index value and energy limit values can be $GI_{Limit}=8$ and $E_{Limit}=2\times10^{-4}$.

In some embodiments the voice activity detector 107 can be configured to determine whether the current frame is voiced and pass this information onto the post-processor 106. In some embodiments the voice activity detector 107 is configured to control the operation of the post processor dependent on the analysis of the current frame.

The operation of analysing the current frame is voiced is shown in FIG. 3 by step 207.

Where the current frame is unvoiced then the voice activity detector can be configured to control the post-processor to operate in a smoothing mode. In some embodiments the smoothing mode occurs where the post filter coefficients are interpolated from frame to frame.

The smoothing mode is shown in FIG. 3 by step 213.

Where the voice activity detector 107 determines the current frame is voiced then the post processor 106 is configured to post filter the audio signals from the signal formatter 102.

In some embodiments the signal analyser 104 comprises a signal to noise estimator 115 the signal to noise estimator 115 can determine a signal to noise level according to any suitable method. In some embodiments a noise estimation is performed as shown in FIG. 4 step 301 and then this value is compared against the signal energy value to determine a signal to noise estimation value.

The determination of the signal to noise estimation is shown in FIG. 4 by step 303.

In some embodiments the signal to noise estimator 115 can further comprise a SNR smoothing filter. The smoothing filter can be any suitable smoothing filter.

The SNR and/or smoothed SNR values can in some embodiments be used to control or determine the formant filters as described herein.

The determination of a smoothed SNR value is shown in FIG. 4 by step 305.

In some embodiments the post processor apparatus comprises a post processor part 106. The post processor part 106 is configured to determine the formant frequency estimates, determine the post filtering structure and apply and further post-processing on the audio signal. The post-processor part 106 can therefore in some embodiments be configured to receive the output of the signal formatter 102 in the form of the audio signal frames and furthermore the output from the signal analyser 104 in the form of the voice activity analysis and signal to noise estimation parameters.

In some embodiments the post processor part 106 comprises a formant estimator 109. The formant estimator 109 is configured to estimate the linear prediction coefficients of the frame. The linear prediction (LP) coefficients of the frame can in some embodiments be calculated by a $10^{th}$ order linear prediction. In some embodiments the formant frequencies can be estimated by picking the peaks of the linear prediction spectrum. In some embodiments a conventional post filter structure $H_{enh}(z)$ can be based on the determined linear prediction coefficients according to the following expression:

$$H_{enh}(z) = \frac{1 - P\left(\frac{z}{0.9}\right)}{1 - P\left(\frac{z}{0.99}\right)},$$

where P(z) is the linear prediction polynomial.

In some embodiments the formant estimator 109 can determine the amplitude response of the post-filter $H_{enh}(z)$ using a 256 sample Fast Fourier Transform (FFT). The formant determiner 109 then in some embodiments can locate the first 3 peaks and compare the determined peaks to the formant locations for a previous frame. The peaks which are closest to the formants of the previous frame can then be selected. Where none of the peaks are determined to be close enough the values of the previous frame can be used instead.

In some embodiments the estimated frequencies of the formants can be determined to the change at most 50 Hz between consecutive frames. In some embodiments the change can be more than or less than 50 Hz.

In some embodiments the formant frequencies can be determined according to long term analysis of voice patterns, for example the formant frequencies can be determined by computing the averages of the first 2 formant frequencies.

In some embodiments the formant frequencies, can be predetermined, stored in memory and recovered by the formant estimator 109. In such embodiments where a constant formant is used then the formant estimator 109 is optional or configured to simply supply to the formant filter generator the constant values. Furthermore in such embodiments where constant formants are implemented then the voice activity detector can be optional and the post-filter applied to all frames using the formant values and with the formant filter parameter $r_1$ dependent on the estimated signal to noise ratio.

Typical values for average formant locations for the first two formants can be $\theta_1$=0.4009 and $\theta_2$=1.2695.

The operation of estimating the formant frequencies is shown in FIG. 3 by step 211.

In some embodiments the post processor 106 comprises a formant filter determiner/modifier 111. The formant filter determiner/modifier 111 is configured in some embodiments to determine a filter structure where the first 2 formants are manipulated according to the determined signal to noise ratio values.

In some embodiments the formant filter determiner/modifier 111 can be configured to determine a post-filter structure expressed as the product of a first and second formant filter. In other words expressed mathematically as:

$$H_{pf}(z)=H_1(z)H_2(z).$$

In some embodiments the filters $H_1(z)$ and $H_2(z)$, which can also be referred to as the formant frequency filters can in some embodiments have the following transfer function structure $$H_1(z) = \frac{1 - 2\cdot 0.9\cdot \theta_i \cdot z^{-1} + 0.9^2 \cdot z^{-2}}{1 - 2\cdot r_i \cdot \theta_i \cdot z^{-1} + r_i^2 \cdot z^{-2}},\ i = 1, 2,$$

where the frequencies of the formants (in radians) is denoted by $\theta_i$ and the values of $r_i$ control whether the formants are amplified or supressed as well as the degree of the modification.

In some embodiments the formant filter determiner/modifier 111 can be configured to modify formant parameters such that dependent on the signal to noise ratio the value of $r_1$ is within the range 0 to 0.9 (in other words attenuating the first formant) and $r_2$ is within the range 0.9 to 1 (in other words amplifying the second formant).

In some embodiments the formant filter determiner/modifier 111 can be configured to receive suitable values of the formant locations $\theta_1$ and $\theta_2$ from the formant estimator 109. As described herein these formant locations can be estimated and therefore variable or constant, for example predetermined values.

In some embodiments the formant filter determiner/modifier 111 can be configured to determine a first set of r values where the signal to noise ratio is good or 'optimal'. In some embodiments these 'optimal' noise value parameters can be determined as $r_1$=0.46 and $r_2$=0.93.

In some embodiments the formant filter determiner/modifier 111 can be configured to receive the signal to noise ratio and compare the signal to noise ratio (or smoothed signal to noise ratio) against a determined noise threshold or thresholds. In the following example a single noise threshold of 0 dB is used however it would be understood that in some embodiments other threshold values can be used.

The formant filter determiner/modifier 111 can in some embodiments be configured to perform two stages of adaptation dependent on the level of the background noise.

The operation of determining whether the signal to noise ratio (or smoothed signal to noise ratio) is greater than a determined noise threshold is shown in FIG. 4 by step 307.

In some embodiments the formant filter determiner/modifier 111 can be configured firstly to determine the value of $r_1$ dependent on the signal to noise ratio, and specifically whether the SNR (or smoothed SNR) is greater than the threshold value.

Where the SNR (or smoothed SNR) value is greater than the threshold value then the $r_1$ value can be set to the 'optimal' noise value. For example as described herein the value can be $r_1$=0.46.

Furthermore in some embodiments the value of $r_2$ is also set to the 'optimal' value for the $r_2$ value. For example as described herein the 'optimal' value of $r_2$ is 0.93.

Furthermore the formant filter determiner/modifier 111 can be configured in some embodiments where the SNR (or smoothed SNR) is greater than the threshold value to perform a neutralisation of the post-filter where the signal to noise ratio (or smoothed SNR) is above the threshold. The neutralisation of the post-filter can be performed in some embodiments by moving the poles and zeros of the cascade of the two formant filters gradually closer to the origin z-plane. This can be expressed as $$H_{NA}(z) = H_1\left(\frac{z}{a}\right)H_2\left(\frac{z}{a}\right)H_{TILT}(z),$$

where the neutralisation can be controlled by the factor $\alpha$. In some embodiments the factor $\alpha$ can be interpolated linearly between 1 and 0 dependent on the SNR (or smoothed SNR) changes from 0 dB to 10 dB. The post filter obtained at 10 dB would in these embodiments produce a nearly flat amplitude response and would produce an almost inaudible processing effect.

The operation of computing the value of a and setting the $r_1$ value to 0.46 when the signal to noise ratio is above the threshold is shown in FIG. 4 by step 309.

Where the signal to noise ratio (or smoothed signal to noise ratio) is less than the determined noise threshold then the formant filter determiner/modifier 111 can be configured in some embodiments to modify the value of $r_1$ to be moved closer to a minimum value.

In some embodiments the formant filter determiner/modifier 111 can be configured to set the $r_1$ value to be between the maximum or 'optimal' value, for example $r_{1,max}$=0.46 and a determined minimum value, for example $r_{1,min}$=0.23, where the SNR (or smoothed SNR) is between the noise threshold and a high noise threshold value, for example 0 dB and −10 dB respectively. In some embodiments the formant filter determiner/modifier 111 can be configured to set the value according to a linear interpolation method.

Furthermore the value of $r_2$ is also set with a value of 0.93.

It would be understood that in some embodiments where a non-smoothed SNR estimate is being used then a frame by frame smoothing of the $r_1$ (and a) values can be implemented so that there are no sudden drastic changes in the frequency response of the post-filter.

Furthermore in these embodiments the formant filter determiner/modifier 111 can be configured to set the factor $\alpha$ to 1.

The determination of the $r_1$ (and $r_2$) value and the setting $\alpha$ to 1 when the SNR is less than the threshold is shown in FIG. 4 by step 311.

The Formant filter determiner/modifier 111 can then be configured to construct the formant filters $H_1(z)$ and $H_2(z)$ using the determined $r_1$, $r_2$ and $\alpha$ values.

The operation of generating the formant filters is shown in FIG. 4 by step 313.

In some embodiments the post processor 106 comprised a tilt filter 117. The tilt filter ($H_{TILT}(z)$) is a filter configured to compensate for the possible spectral tilt in the processed speech caused by the cascade of the two formant filters. The tilt filter can in some embodiments be a first order low pass filter according to the following expression:

$$H_{TILT}(z) = \frac{1}{1-\mu z^{-1}},$$

where $\mu$ is computed from a first order linear prediction analysis of the cascade of the formant filters.

The construction of the tilt filter is shown in FIG. 4 by step 315.

In some embodiments the post processor part comprises an interpolator 113. In such embodiments the filter coefficients can be interpolated between frames to avoid generating audio artefacts caused by sudden transitions between consecutive frames in embodiments where the filter parameters are determined by non-smoothed signal to noise ratio estimation. In other words in some embodiments the prevention of audio artefacts can be controlled by the use of smoothing to the signal to noise ratio estimation, in some embodiments by the smoothing of filter parameters from frame to frame.

In some embodiments the interpolator 113 can be configured to perform interpolation every $20^{th}$ sample. In such embodiments the coefficients of the formant and tilt filters can be transformed to the line spectral frequency (LSF) domain and the interpolated linearly.

The transformation to the line spectral frequencies is performed in some embodiments to ensure that the filter remains stable even though its coefficients change. The filter coefficients for a sub frame of 20 samples can be obtained according to the following expression:

$$a_{sf} = \left(1 - \frac{i}{N-1}\right)a_{cf} + \frac{i}{N-1}a_{nf},$$

where $a_{sf}$ denotes the subframe coefficients, $a_{cf}$ the coefficients of the current frame and $a_{nf}$ those of the next frame. The length of the frame is N and the starting index of subframe inside the larger frame is I, where i is less or equal to 0 but greater than or equal to N−1.

In some embodiments both the numerator and denominator coefficients of the subframe filter can be interpolated separately.

The operation of interpolation is shown in FIG. 3 by step 219.

Where the next frame is unvoiced then the operation passes directly to adaptive gain control for the current frame.

The post processor part 206 can then apply the combination of the formant and tilt filters to generate a post-filter output.

The operation of post-filtering the audio signal is shown in FIG. 4 by step 317.

Furthermore the operation of generating the post-filter is shown in FIG. 3 by step 215.

In some embodiments the post processor part 106 comprises an adaptive gain controller 119. The adaptive gain controller 119 can be configured to adjust the energy of the processed signal to correspond to that of the ordinary speech signal. In some embodiments the speech frames can be processed in 5 ms subframes with the scaling factor determined according to the following expression:

$$\gamma = \sqrt{\frac{\sum_{n=0}^{39}(s(n))^2}{\sum_{n=0}^{39}(s_{pf}(n))^2}},$$

where s(n) is the received or input signal and $s_{pf}(n)$ is the post filtered signal.

In some embodiments the adaptive gain controller 119 can then be configured to apply a gain to the output of the post-filter according to the following expression:

$$s_{sc}(n)=\beta(n)s_{pf}(n),$$

where $\beta(n)=0.9\beta(n-1)+0.1\gamma$. The values of $\beta(n)$ can in some embodiments be calculated for every sample and used to smooth the changes between samples.

The operation of performing adaptive gain control is shown in FIG. 3 and in FIG. 4 by step 221.

Figure 5:
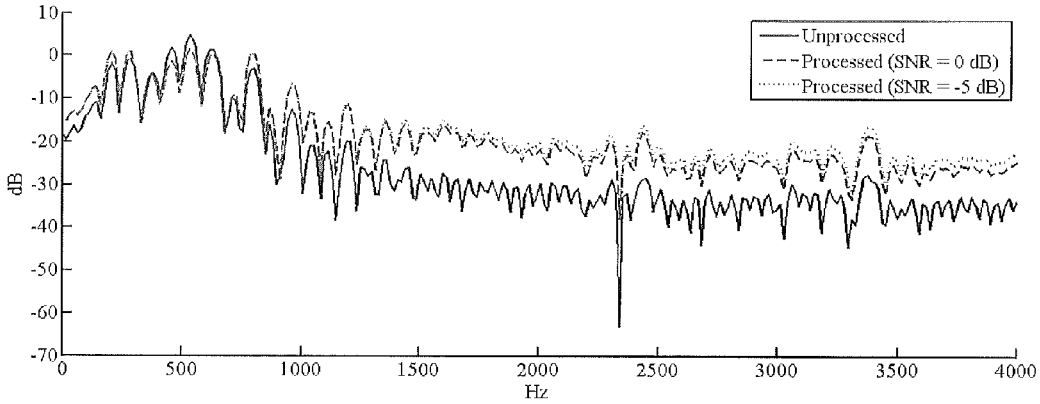
FIG. 5 shows a graphical representation of a spectral speech sample with various levels of filtering according to some embodiments.
Figure 6:
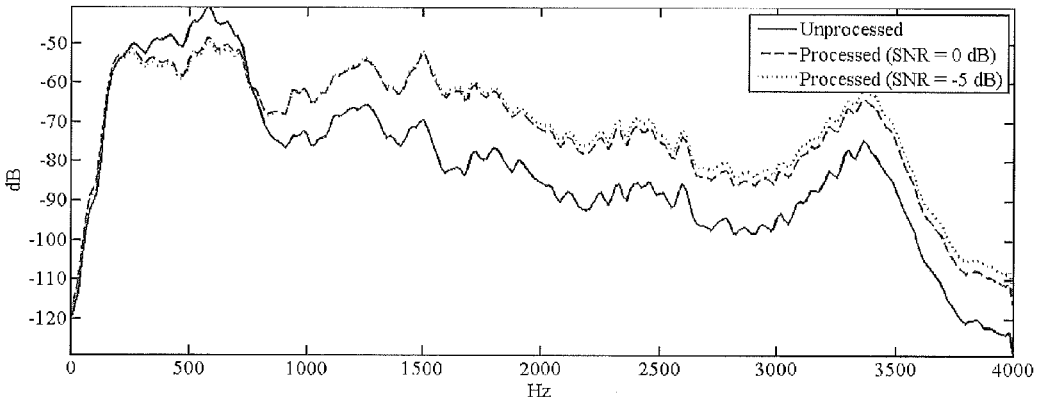
FIG. 6 shows a graphical representation of further spectral speech samples with various levels of filtering according to some embodiments.

With respect to FIGS. 5 and 6 examples of the post-filter spectral speech outputs are shown for unprocessed audio signals, processed −5 dB SNR and processed −10 dB SNR outputs showing the effect of the formant and tilt filtering according to the embodiments described herein.

In the embodiments as described above a two formant frequency filter is configured and generated with parameters dependent on the signal to noise ratio of the input audio signal. In other words the concept can be seen as generating a filter which is configured to move the audio signal energy from lower frequencies to higher frequencies. It would be understood that in some embodiments this can be achieved by other implementations such as a second or higher formant frequency filter which is configured to amplify the 'filtered' formant frequencies relative to earlier formant frequencies. Furthermore although only two formant frequencies are described herein in some embodiments more than two formants can be filtered dependent on the signal to noise ratio such that the higher formant frequency components are amplified relative to at least one lower formant frequency component.

Although the above examples describe embodiments of the application operating within a codec within an apparatus 10, it would be appreciated that the invention as described below may be implemented as part of any audio (or speech) codec, including any variable rate/adaptive rate audio (or speech) codec. Thus, for example, embodiments of the application may be implemented in an audio codec which may implement audio coding over fixed or wired communication paths.

Thus user equipment may comprise an audio codec such as those described in embodiments of the application above.

It shall be appreciated that the term user equipment is intended to cover any suitable type of wireless user equipment, such as mobile telephones, portable data processing devices or portable web browsers.

Furthermore elements of a public land mobile network (PLMN) may also comprise audio codecs as described above.

In general, the various embodiments of the application may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the application may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

Thus at least some embodiments may be an apparatus comprising at least one processor and at least one memory including computer program code the at least one memory and the computer program code configured to, with the at least one processor, cause the apparatus at least to perform: estimating a signal to noise ratio value for an audio signal; generating a post-filter comprising at least one of: a first formant frequency filter and a second formant frequency filter, wherein the post-filter is dependent on the signal to noise ratio value for the audio signal.

The embodiments of this application may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions.

Thus at least some embodiments may be a computer-readable medium encoded with instructions that, when executed by a computer perform: estimating a signal to noise ratio value for an audio signal; generating a post-filter comprising at least one of: a first formant frequency filter and a second formant frequency filter, wherein the post-filter is dependent on the signal to noise ratio value for the audio signal.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the application may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules.

Once the design for a semiconductor circuit has been completed, the resultant design, in a standardized electronic format (e.g., Opus, GDSII, or the like) may be transmitted to a semiconductor fabrication facility or "fab" for fabrication.

As used in this application, the term 'circuitry' refers to all of the following:

(a) hardware-only circuit implementations (such as implementations in only analog and/or digital circuitry) and (b) to combinations of circuits and software (and/or firmware), such as: (i) to a combination of processor(s) or (ii) to portions of processor(s)/software (including digital signal processor(s)), software, and memory(ies) that work together to cause an apparatus, such as a mobile phone or server, to perform various functions and (c) to circuits, such as a microprocessor(s) or a portion of a microprocessor(s), that require software or firmware for operation, even if the software or firmware is not physically present.

This definition of 'circuitry' applies to all uses of this term in this application, including any claims. As a further example, as used in this application, the term 'circuitry' would also cover an implementation of merely a processor (or multiple processors) or portion of a processor and its (or their) accompanying software and/or firmware. The term 'circuitry' would also cover, for example and if applicable to the particular claim element, a baseband integrated circuit or applications processor integrated circuit for a mobile phone or similar integrated circuit in server, a cellular network device, or other network device.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. A method for processing an audio signal comprising:

estimating a signal to noise ratio value for an audio signal comprising one or more frames;

determining at least one of the one or more frames is voiced;

generating a post-filter comprising at least one of: a first formant frequency filter, a second formant frequency filter, and a formant frequency parameter, wherein the post-filter is dependent on the signal to noise ratio value for the audio signal and the formant frequency parameter is configured to emphasize a second formant frequency of the audio signal relative to a first formant frequency dependent on the signal to noise ratio value for the audio signal; and generating a post-filter neutralization factor dependent on the signal to noise ratio value for the audio signal.

2. The method as claimed in claim 1, wherein the post-filter is configured to move energy of the audio signal to higher frequencies.

3. The method as claimed in claim 1, wherein when generating the post-filter comprising the first formant frequency filter, further comprises generating a first formant frequency parameter configured to attenuate first formant frequency components of the audio signal dependent on the signal to noise ratio value for the audio signal and enhance the second formant adaptively according to an estimated noise level.

4. The method as claimed in claim 3, wherein generating the first formant frequency parameter dependent on the signal to noise ratio value for the audio signal comprises:

comparing the signal to noise ratio value for the audio signal against a first signal to noise ratio threshold value;

generating a maximum post-filter first formant frequency parameter value dependent on the signal to noise ratio value for the audio signal being greater than the signal to noise ratio threshold value; and generating a second post-filter formant frequency parameter value dependent on the signal to noise ratio value for the audio signal being less than the signal to noise ratio threshold value.

5. The method as claimed in claim 4, wherein generating the second post-filter formant frequency parameter value dependent on the signal to noise ratio value for the audio signal being less than the signal to noise ratio threshold value comprises:

comparing the signal to noise ratio value for the audio signal against a second signal to noise ratio threshold value, wherein the second signal to noise ratio threshold value is lower than the first signal to noise ratio threshold value;

setting the second post-filter formant frequency parameter value to at least one of: a minimum post-filter formant frequency parameter value when the signal to noise ratio value for the audio signal is equal to or less than the second signal to noise ratio threshold value, and an interpolated value between the minimum post-filter formant frequency parameter value and the maximum post-filter formant frequency parameter value when the signal to noise ratio value for the audio signal is greater than the second signal to noise ratio threshold value but less than the first signal to noise ratio threshold value.

6. The method as claimed in claim 5, wherein setting the second post-filter formant frequency parameter value to the interpolated value comprises at least one of:

a linearly interpolated value; and a non-linearly interpolated value.

7. The method as claimed in claim 1, wherein the post-filter neutralization factor dependent on the signal to noise ratio for the audio signal comprises:

comparing the signal to noise ratio value for the audio signal against a first signal to noise ratio threshold value;

generating a minimum post-filter neutralization factor dependent on the signal to noise ratio value for the audio signal being less than the signal to noise ratio threshold value; and generating a second post-filter neutralization factor dependent on the signal to noise ratio value for the audio signal being greater than the signal to noise ratio threshold value.

8. The method as claimed in claim 7, wherein generating the second post-filter neutralization factor dependent on the signal to noise ratio value for the audio signal being greater than the signal to noise ratio threshold value comprises:

generating a maximum post-filter neutralization factor when the signal to noise ratio value for the audio signal is greater than a third signal to noise ratio threshold, the third signal to noise ratio threshold being greater than the first signal to noise ratio threshold; and generating an interpolated post-filter neutralization factor between the maximum post-filter neutralization factor and the minimum post-filter neutralization factor when the signal to noise ratio value for the audio signal is greater than the first signal to noise ratio threshold and less than the third signal to noise ratio threshold.

9. The method as claimed in claim 1, wherein the formant frequency parameter is configured to emphasize the second formant frequency so as to amplify the second formant frequency of the audio signal relative to the first formant frequency dependent on the signal to noise ratio value for the audio signal.

10. The method as claimed in claim 9, further comprising estimating at least one of the first formant frequency and the second formant frequency.

11. The method as claimed in claim 1, wherein estimating the signal to noise ratio value for the audio signal comprises at least one of:

generating a smoothed signal to noise ratio: and low pass filtering the estimated signal to noise ratio over the one or more frames of the audio signal.

12. An apparatus comprising at least one processor and at least one memory including computer code for one or more programs, the at least one memory and the computer code configured to with the at least one processor to cause the apparatus to at least:

estimate a signal to noise ratio value for an audio signal comprising one or more frames;

determine at least one of the one or more frames is voiced;

generate a post-filter comprising at least one of a first formant frequency filter, a second formant frequency filter, and a formant frequency parameter, wherein the post-filter is dependent on the signal to noise ratio value for the audio signal and the formant frequency parameter is configured to emphasize a second formant frequency of the audio signal relative to the first formant frequency dependent on the signal to noise ratio value for the audio signal; and generate a post-filter neutralization factor dependent on the signal to noise ratio value for the audio signal.

13. The apparatus as claimed in claim 12, wherein the generated post-filter comprises the first formant frequency filter causes the apparatus to generate a first formant frequency parameter configured to attenuate first formant frequency components of the audio signal dependent on the signal to noise ratio value for the audio signal and enhance the second formant adaptively according to an estimated noise level.

14. The apparatus as claimed in claim 12, wherein the formant frequency parameter is configured to emphasize the second formant frequency so as to amplify the second formant frequency of the audio signal relative to the first formant frequency dependent on the signal to noise ratio value for the audio signal.

15. The apparatus as claimed in claim 12, wherein the signal to noise ratio value is estimated further causes the apparatus to at least one of:

generate a smoothed signal to noise ratio; and low pass filter the estimated signal to noise ratio over the one or more frames of the audio signal.

16. An apparatus comprising: a signal to noise estimator configured to estimate a signal to noise ratio value for an audio signal comprising one or more frames; a voice activity detector configured to determine at least one of the one or more frames is voiced; a post-filter generator configured to generate a post-filter comprising at least one of: a first formant frequency filter, a second formant frequency filter, and a formant frequency parameter, wherein the post-filter is dependent on the signal to noise ratio value for the audio signal and the formant frequency parameter is configured to emphasize a second formant frequency of the audio signal relative to a first formant frequency dependent on the signal to noise ratio value for the audio signal; and a post-filter neutralization factor generator dependent on the signal to noise ratio value for the audio signal.

17. The apparatus as claimed in claim 16, wherein the post-filter generator comprises a first formant filter generator configured to generate a first formant frequency parameter configured to attenuate first formant frequency components of the audio signal dependent on the signal to noise ratio value for the audio signal and enhance the second formant adaptively according to an estimated noise level.

18. The apparatus as claimed in claim 16, wherein the second formant frequency parameter generator configured to emphasize a second formant frequency component so as to amplify the second formant frequency of the audio signal relative to the first formant frequency dependent on the signal to noise ratio value for the audio signal.

* * * * *